US005797552A

United States Patent [19]

Enderlin

[11] Patent Number: 5,797,552

[45] Date of Patent: Aug. 25, 1998

[54] DEVICE FOR GUIDING FILAMENTS IN TEXTILE MACHINES

[75] Inventor: Robert Enderlin, Morschwiller-Le-Bas, France

[73] Assignee: SUPERBA Societe Anonyme a Directoire et Conseil de Surveillance, Mulhouse, France

[21] Appl. No.: 856,004

[22] Filed: May 14, 1997

[30] Foreign Application Priority Data

May 20, 1996 [FR] France ..... 96 06383

[51] Int. Cl.[6] ..... B65H 57/00; D02H 5/02; D02H 13/16

[52] U.S. Cl. ..... 242/157 R; 242/615.2; 28/183; 28/212

[58] Field of Search ..... 242/157 R, 615, 242/615.2; 28/178, 202, 212, 183

[56] References Cited

U.S. PATENT DOCUMENTS

| | | | |
|---|---|---|---|
| 3,012,393 | 12/1961 | Shuttleworth et al. | 242/157 R X |
| 3,231,167 | 1/1966 | Heuvelmans | 242/157 R X |
| 3,293,720 | 12/1966 | Cumbers | 28/212 |
| 3,990,132 | 11/1976 | Illman et al. | 28/178 |
| 4,222,758 | 9/1980 | Stotler et al. | 242/157 R X |

FOREIGN PATENT DOCUMENTS

| | | |
|---|---|---|
| 2 470 179 | 5/1981 | France . |
| 32 01 400 | 7/1983 | Germany . |
| 33 03 024 | 8/1984 | Germany . |

*Primary Examiner*—Michael Mansen
*Attorney, Agent, or Firm*—Young & Thompson

[57] ABSTRACT

A device for guidance and/or support of filaments, particularly for textile machines working with wet filaments, comprising a guide and/or support (1) for the individual filaments (2) of a layer of filaments, mounted with the possibility of rotation on a carrying chassis (3) secured to the machine (4) or directly in bearings provided on the machine (4). The guide (1) for the individual filaments (2) of a layer of filaments is mounted retractably on the carrying chassis (3) secured to the machine (4) or in bearings provided on the machine (4). The invention is particularly applicable to the field of textile industry.

22 Claims, 2 Drawing Sheets

DEVICE FOR GUIDING FILAMENTS IN TEXTILE MACHINES

BACKGROUND OF THE INVENTION

The present application is based on a French application 96 06383 of May 20, 1996, the disclosure of which is incorporated herein by reference.

The present invention relates to the field of textile industry, in particular the treatment of filaments, especially by washing and/or dyeing the filaments and has for its object a guide and/or support device for filaments, in particular for textile machines working with wet filaments.

Textile filaments are generally subjected, before their use, particularly for weaving, to treatments of washing and/or bleaching as well as dyeing. These different treatments are carried out wet, having as a result moisture in the filaments during all the duration of treatment at the passage to the different treatment stations.

At the entry of these latter, the filaments must be perfectly maintained and guided, so as to avoid any overlap prejudicial to good operation.

At present, the maintenance and guiding devices consist generally of combs, and, if desired, of fixed supports. The combs are present in the form of an assembly of teeth disposed at regular intervals on a support bar, as the case may be adjustable, each interval between teeth providing the guidance for one filament. The fixed supports are generally in the form of cylindrical bars extending transversely to a layer of filaments and below this latter. Such bars are also used to carry out the maintenance of a layer of filaments against vibrations occasioning lateral displacement of filaments which can give rise to troublesome intermixing of said filaments.

However, during passage of the filaments on the guidance and maintenance devices, the outer fibers, which rub on said devices, break and detach from said filaments and accumulate on the combs and other guides, which they plug by forming a wad. In the case of the guidance of dry filaments, this wad can easily be detached, during operation, by blowing or other cleaning.

However, during treatment of wet filaments, following washing or dyeing, the guidance becomes more complicated, the wet wad during formation binding together and agglomerating on the guiding support, on which it chafes the filament and from which it cannot be detached by the known dry processes. Thus, the wet filament forms, where it undergoes friction, a tuft which solidifies and which periodically detaches and is carried along by the filament.

As a result, the filament breaks and tangles with adjacent filaments or else the tuft grows and is carried along by the filament and wound with this latter, which has as a result a defect in the bobbins. According to the frequency of formation of tufts, the corresponding cleaning becomes difficult and requires an undesirable repetition with the risk of derangement and breaking of the filaments. The same problems arise with smooth supports for layers of filaments.

As a result, correct cleaning of the guides or of the supports is not a practical matter except with complete stopping of the treatment line, which gives rise to undesirable disturbances of productivity.

There is known from DE-A-32 01 400, a device for guiding and/or supporting filaments, in particular for textile machines working with wet filaments, which is constituted by guide and/or support means for the individual filaments of a layer of filaments, mounted with the possibility of rotation on a carrying frame secured to the machine or directly in the bearings provided on said machine, said guidance and/or support means for the individual filaments being in the form of a rotatable cone constituted by a stack of disks separated by spacers. Comparable devices are also known from DE-A-33 03 024, as well as FR-A2 470 179.

However, these known devices have no possibility of individual retraction, particularly for simple removal, nor means permitting improvement of threading.

SUMMARY OF THE INVENTION

The present invention has for its object to overcome these drawbacks by providing a guidance and/or support device for filaments, particularly for machines working with wet filaments, permitting optimum guiding and/or maintenance of the filaments of a layer, whilst avoiding the formation of wet agglomerated tufts that would militate against the good operation of a treatment line and permitting an improvement in threading.

To this end, the guidance and/or support device for filaments, in particular for textile machines working with wet filaments, which is essentially constituted by guidance and/or support means for the individual filaments of a layer of filaments, mounted with the possibility of rotation on a carrying chassis secured to the machine or directly in bearings provided on said machine, said guidance and/or support means of the individual filaments being in the form of a rotatable comb constituted by a stack of disks (5) separated by spacers, is characterized in that the guidance and/or support means for the individual filaments of a layer of filaments is mounted retractably on the carrying chassis secured to the machine or in the bearings provided on the machine.

BRIEF DESCRIPTION OF THE DRAWINGS

The invention will be better understood, from the following description, which relates to a preferred embodiment, given by way of non-limiting example, and explained with reference to the accompanying schematic drawings, in which.

BRIEF DESCRIPTION OF THE PREFERRED EMBODIMENTS

Figures 1A, 1B:
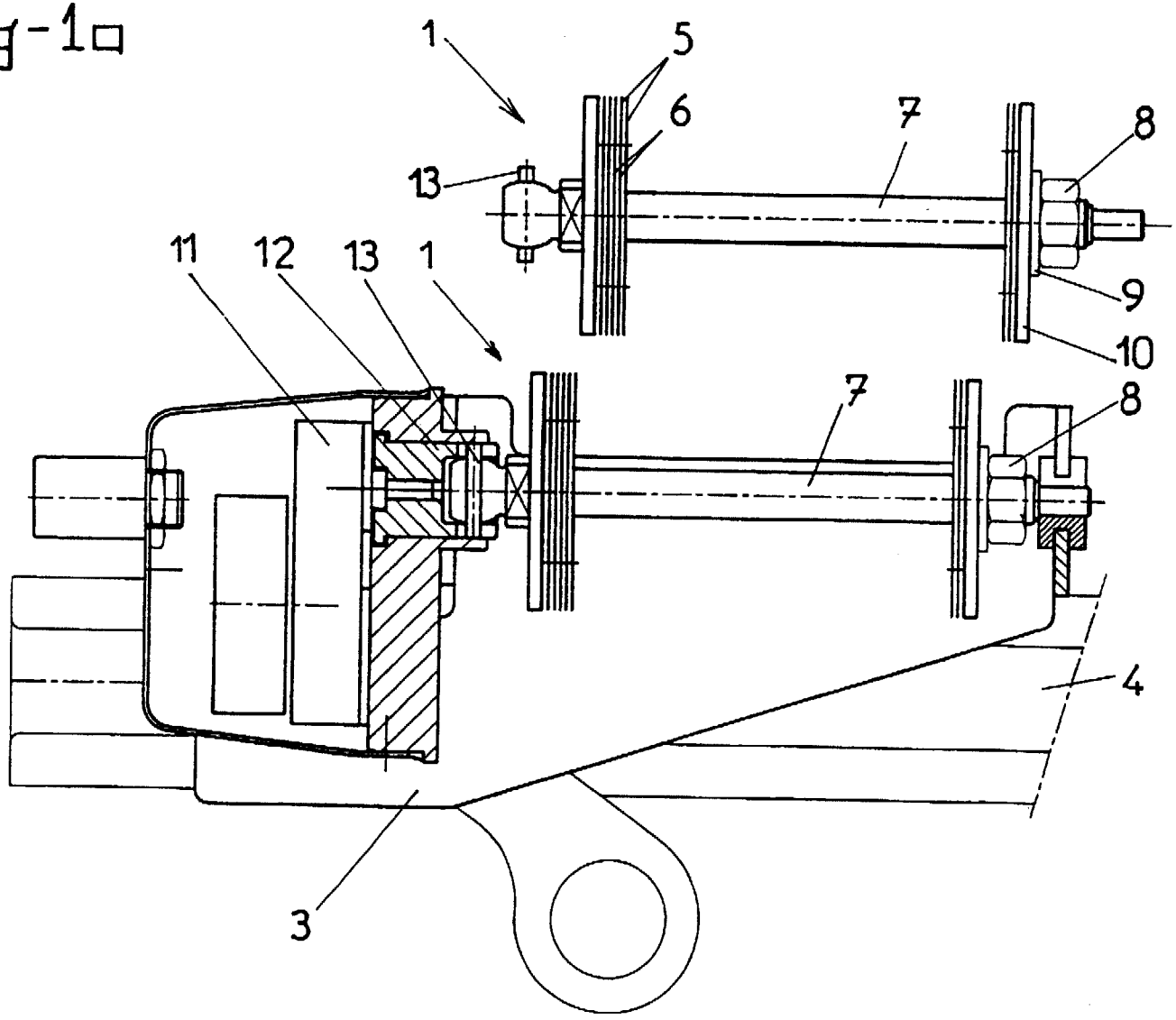
FIG. 1(*a*) is a side elevational view and FIG. 1(*b*) is a cross sectional view of a device according to the invention, the guidance and/or support means for the filaments being shown in the service position and in the extraction condition of its bearings.
Figure 3:
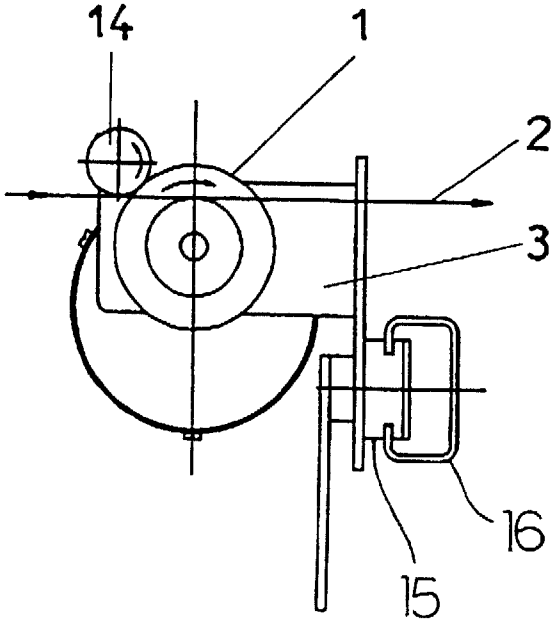
FIG. 3 is a front elevational view of FIG. 2.
Figure 2:
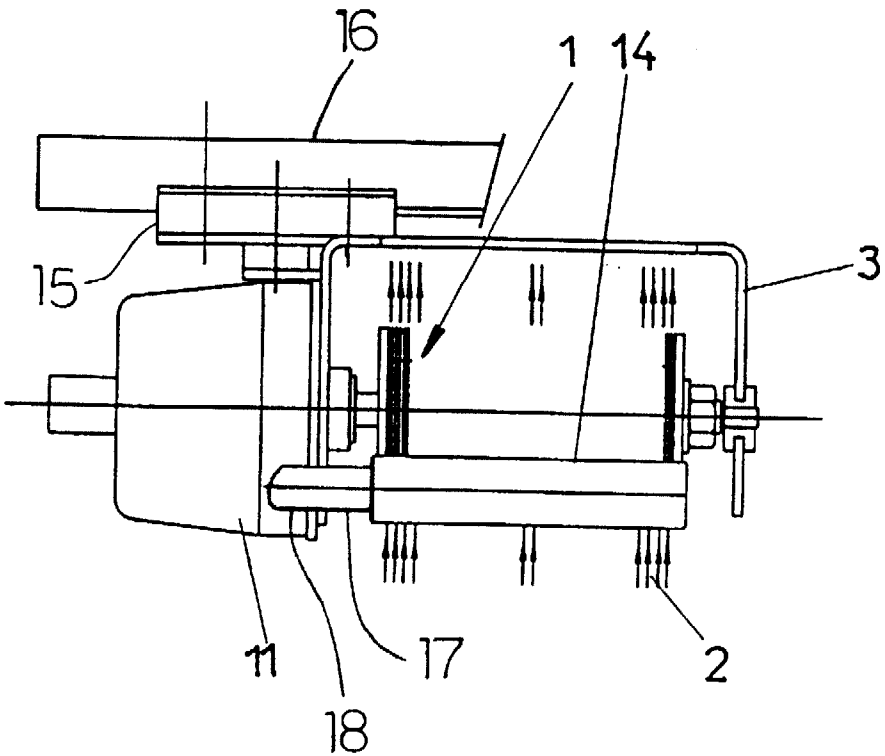
FIG. 2 is a plan view on a smaller scale, of the device of FIG. 1.

FIGS. 1 to 3 of the accompanying drawings show by way of example a guidance and/or support device for filaments, in particular for textile machines working with wet filaments, which is essentially constituted by a means 1 for guidance and/or support of the individual filaments 2 of a layer of filaments, mounted with the possibility of rotation on a carrying chassis 3 secured to the machine 4 or directly in the bearings provided on said machine 4, said guidance and/or support means 1 of the individual filaments 2 being in the form of a rotatable comb constituted by a stack of disks 5 separate by spacers 6.

According to the invention, the means 1 for guidance and/or support of the individual filaments 2 of a layer of filaments is mounted retractably on the carrying chassis 3 secured to the machine 4 or in bearings provided on the machine 4.

The mounting of the means 1 with the possibility of rotation permits the moving filament always to rise from the previous layers during its passage over said means 1, such that this latter becomes self-cleaning. This means 1 for guidance and/or support of the individual filaments 2 of a layer of filaments is in the form of a rotatable comb constituted by a stack of disks 5 separated by spacers 6, the assembly being clamped on a shouldered shaft 7 by means of a nut 8 and washers 9 and 10. As a function of the titer or metric number of filaments to be guided, the spacing between the disks 5 and their thickness can be modified, respectively by replacement of the spacers 6 by thicker or thinner spacers or by replacement of the disks 5 by thicker or thinner disks 5.

Moreover, the disks 5 are preferably provided with a peripheral chamfered edge. As a result, the threading of the filaments is facilitated, these being guided during this operation so as to be brought to the bottom delimited between two adjacent disks 5.

Such a comb thus permits a complete adaptation to all configurations of layers of filaments possible, by simple mounting of the disks 5 and corresponding spacers 6 as needed.

According to another characteristic of the invention, and as shown more particularly in FIG. 1(*b*) of the accompanying drawings, the means 1 for guidance and/or support of the individual filaments 2 of a layer of filaments is mounted retractably on the carrying chassis 3 secured to the machine 4 or in bearings provided on the machine 4. To this end, at least one of the bearings of the chassis 3 or those provided on the machine 4 is an open bearing, whilst the other bearing is an annular bearing. Thus, the cleaning of the means 1, between two filament treatment operations, is facilitated and can particularly be carried out with an air jet, without risk of damage, in particular for the electric circuits of the machine, the means 1 being simply extracted from its bearings by raising one of its ends from the open bearing and retraction of the other bearing from its recess.

The means 1 can be simply mounted in a removable manner in the smooth bearings of the support 3, its drive and rotation being carried out by the friction of the passing filaments 2.

Preferably, the guidance and/or support means 1 of the individual filaments 2 of a layer of filaments coacts, by means of one of its ends, with a drive device 11 provided on the carrying chassis 3 or on at least one bearing secured to the machine 4. Such a drive device 11 permits insuring a constant speed of rotation which can be perfectly adapted to the linear speed of the travelling filaments, such that relative friction of the filaments on the means 1 can be reduced in an optimum manner.

The drive device 11 is preferably constituted as a motor reducer assembly provided on its output shaft with a drive 12 coacting with an element 13 on the corresponding end of the shouldered shaft 7 of the means 1 (FIG. 1). The drive 12 is preferably in the form of a stirrup having in its legs slots for the reception of element 13 in the form of a pin traversing the end of the shouldered shaft 7, this end being constituted by a rotor and the bearing for the chassis 3, or provided directly on the machine 4, opposite the drive device 11, is an open bearing. As a result of this construction, simple disengagement and rapid replacement of the means 1, as shown in FIG. 1 of the accompanying drawings, is made possible.

So as to insure perfect maintenance of the filaments along the means 1, and in particular between the disks 5 forming the teeth of the comb, the device is completed by a rotatable maintenance cylinder 14 extending in front of the means 1, as seen in the direction of movement of the filaments 2, and above these latter, this rotatable maintenance cylinder 14 being mounted on the chassis 3 or directly on the machine 4. Such a cylinder 14 permits maintaining the filaments 2 perfectly along the means 1, thereby to avoid jumping of the filaments and tangling during movement.

According to one characteristic of the invention, the rotatable maintenance cylinder 14 is mounted on the chassis 3 or on the machine 4 with a pivot 18, particularly in the direction of movement of the filaments 2, with indexing in the end positions of pivoting. A pivotal mounting of the cylinder 14 and its indexing in position are not described or shown in detail, but can be carried out by means of the elbowed lever or other useful device, at its end opposite that carrying the cylinder 14, with an indexing means in the form of a snap connection or a spring loaded ball and recesses of corresponding cross section.

According to another characteristic of the invention, the rotatable maintenance cylinder 14 can be provided with a motor reducer 17 for driving it in rotation, preferably with reduced frictional contact between the filaments 2.

According to another characteristic of the invention, and as shown in FIG. 3 of the accompanying drawings, the rotatable maintenance cylinder 14 is in contact, by its periphery, with the periphery of the means 1 for guidance and/or support of the individual filaments 2 and is driven in rotation by said means 1, by contact. Of course, it is equally possible to provide a contact drive of the rotatable maintenance cylinder means 14 provided with a motor reducer for driving in rotation, the guidance and/or support means 1 of the individual filaments 2 being simply mounted in smooth bearings.

Finally, according to another characteristic of the invention, in the case of the mounting of the guidance and/or support means of the individual filaments 2 on a carrying chassis 3, this latter can be fixed to the machine 4 by means of a carriage 15 displaceable on a rail 16 of the machine 4, transversely to the direction of movement of the filaments 2 (FIGS. 2 and 3). Thus, it is possible to displace the means 1 from the normal path of the filaments 2, which can be particularly advantageous for the removal of filaments from difficultly accessible places.

Thanks to the invention, it is possible to provide a guidance and/or support device for filaments, particularly for textile machines working with wet filaments, permitting avoiding an accumulation of a wet wad, by self-cleaning of said device during the continuous movement of the filaments. There results an easier use of the machines having such devices and an improvement in productivity because the down times of the machines can be considerably reduced.

Moreover, because better maintenance of the filaments avoids tangling and because the agglomeration of tufts is avoided, ruptures of the filaments are also reduced considerably, which also has a favorable influence on productivity.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. A device for guiding filaments comprising:

a chassis;

a comb mounted on said chassis and comprising a stack of disks separated by spacers; and bearing means for removably and rotatably mounting said comb on said chassis.

2. The device of claim 1, wherein said disks have chamfered edges.

3. The device of claim 1, wherein said bearing means comprises an annular bearing in said chassis for receiving one end of said comb and an open bearing in said chassis for receiving another end of said comb.

4. The device of claim 1, further comprising a driver carried by said chassis for rotatably driving said comb.

5. The device of claim 4, wherein said comb comprises a shaft on which said disks and spacers are mounted, one end of said shaft comprising a projection, wherein said driver comprises a motor reduction assembly comprising an element for receiving said projection.

6. The device of claim 5, wherein said one end of said shaft is a ball and said projection is a pin projecting from said ball, and wherein said element is a stirrup with a recess for receiving said pin.

7. The device of claim 6, wherein said bearing means comprises an annular bearing in said chassis for receiving said ball.

8. The device of claim 1, further comprising a holding cylinder rotatably mounted on said chassis on a side of said comb that is for receiving the filaments.

9. The device of claim 8, further comprising a pivot for pivoting said holding cylinder into an operable position generally parallel to an axis of said comb.

10. The device of claim 8, further comprising a motor reducer for driving said holding cylinder.

11. The device of claim 10, wherein an exterior of said holding cylinder contacts an exterior of said comb and said comb is driven thereby.

12. The device of claim 8, wherein an exterior of said holding cylinder contacts an exterior of said comb and said holding cylinder is driven thereby.

13. The device of claim 1, further comprising a guide rail external to said chassis, and wherein said chassis is mounted on a carriage movably carried by said guide rail generally parallel to an axis of said comb.

14. The device of claim 1, wherein said chassis is adapted to be attached to a textile machine.

15. A device for guiding filaments comprising:

a guide rail for being mounted on a textile machine;

a chassis mounted on a carriage, said carriage being movably carried by said guide rail generally perpendicular to a direction of movement of the filaments; and a comb retractably and rotatably mounted on said chassis and comprising a stack of disks separated by spacers.

16. The device of claim 15, wherein comb comprises a shaft carrying said disks and said spacers, said bearing means comprises an annular bearing in said chassis for receiving one end of said shaft and an open bearing in said chassis for receiving another end of said shaft.

17. The device of claim 15, wherein said guide rail is generally parallel to an axis of said comb.

18. A device for guiding filaments comprising:

a chassis;

a comb retractably and rotatably mounted on said chassis and comprising a stack of disks separated by spacers; and a holding cylinder rotatably and pivotably mounted on said chassis so as to be pivotable into an operable position generally perpendicular to a direction of movement of the filaments.

19. A device for guiding filaments comprising:

a chassis;

a comb retractably and rotatably mounted on said chassis and comprising a stack of disks separated by spacers;

a holding cylinder mounted on said chassis; and a motor reducer for rotating said holding cylinder.

20. The device of claim 19, wherein an exterior of said holding cylinder contacts an exterior of said comb and said comb is driven thereby.

21. A device for guiding filaments comprising:

a chassis;

a comb retractably and rotatably mounted on said chassis and comprising a stack of disks separated by spacers;

a holding cylinder mounted on said chassis, an exterior of said holding cylinder contacting an exterior of said comb so that said holding cylinder is driven thereby.

22. The device of claim 21, further comprising a driver carried by said chassis for rotatably driving said comb.

* * * * *